US006827291B2

(12) United States Patent
Townsend

(10) Patent No.: US 6,827,291 B2
(45) Date of Patent: Dec. 7, 2004

(54) REVERSIBLE ADJUSTABLE ARC SPRINKLER

(75) Inventor: Michael Townsend, Waitsburg, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 48 days.

(21) Appl. No.: 10/377,786

(22) Filed: Mar. 4, 2003

(65) Prior Publication Data

US 2004/0046055 A1 Mar. 11, 2004

Related U.S. Application Data

(63) Continuation-in-part of application No. 10/216,798, filed on Aug. 13, 2002.

(51) Int. Cl.[7] ..... B05B 3/16; B05B 15/10; B05B 3/00; B05B 3/02; B05B 3/04

(52) U.S. Cl. ..... 239/242; 239/206; 239/222.11; 239/222.17; 239/227; 239/233; 239/237; 239/247; 239/252; 239/255

(58) Field of Search ..... 239/242, 206, 239/222.11, 222.17, 227, 233, 237, 247, 252, 255, 214, 223, 224, 230, 243, 251, 258, 463, 479, 483, 498, 503

(56) References Cited

U.S. PATENT DOCUMENTS 4,540,125 A 9/1985 Gorney et al.
4,763,839 A 8/1988 Greenberg
4,805,838 A 2/1989 Greenberg
5,058,806 A 10/1991 Rupar
RE33,823 E 2/1992 Nelson et al.
5,288,022 A 2/1994 Sesser
5,372,307 A * 12/1994 Sesser ..... 239/210
5,671,886 A * 9/1997 Sesser ..... 239/222.21
6,494,384 B1 * 12/2002 Meyer ..... 239/222.11

* cited by examiner

*Primary Examiner*—Michael Mar
*Assistant Examiner*—Darren Gorman
(74) *Attorney, Agent, or Firm*—Nixon & Vanderhye P.C.

(57) ABSTRACT

A reversible, adjustable arc sprinkler head comprising a sprinkler body incorporating a fixed nozzle; a spray plate mounted on one end of a support cage for rotation with the support cage in one or the other of two opposite directions about a first axis arranged coaxially with a stream emitted from the nozzle, and for back and forth tilting motion about a second axis perpendicular to the first axis, an opposite end of the support cage secured to a sleeve rotatably mounted in the sprinkler body, the spray plate having a pair of substantially parallel grooves for selectively receiving the stream, wherein the direction of rotation of the spray plate about the first axis is determined by the tilting motion of the spray plate about the second axis; and a shift lever formed with an aperture sized to receive the stream, the shift lever mounted at one end on the sleeve for rotation about a third axis parallel to the first axis, the shift lever enabled to shift the stream from one of the pair of grooves to the other of the pair of grooves to thereby reverse the direction of rotation of the spray plate.

17 Claims, 19 Drawing Sheets

REVERSIBLE ADJUSTABLE ARC SPRINKLER

This is a continuation-in-part application of Ser. No. 10/216,798 filed Aug. 13, 2002.

TECHNICAL FIELD

This invention relates to a reversible, adjustable arc sprinkler head.

BACKGROUND AND SUMMARY OF THE INVENTION

Typical reversible, adjustable arc sprinklers employ various mechanisms to reverse the direction of rotation of the sprinkler head including, for example, mechanical trippers and magnets. See U.S. Pat. Nos. 4,805,838; 4,763,839 and 4,540,125. There remains a need, however, for a reversible, adjustable arc sprinkler of simple and reliable construction.

The present invention provides a reversible, adjustable arc sprinkler head that is driven by the flow of water from a fixed nozzle. In one exemplary embodiment, the sprinkler head is of the type in which a fixed nozzle is mounted within a sprinkler body, and a rotatable spray plate is supported by a cap releasably secured to the body, in axially spaced relation to the nozzle. The spray plate is mounted in a cage that is, in turn, mounted on a shaft for rotation about a first vertical axis through the sprinkler body. The spray plate is also mounted within the cage for tilting movement about a second, horizontal axis, perpendicular to the first axis. The spray plate is formed with a pair of parallel water distribution grooves that are shaped to redirect a vertical stream emitted from the nozzle into a generally radially outwardly directed stream. A center barrier between the two distribution grooves is centered relative to the nozzle, such that when the spray plate tilts in one of two opposite directions, it will receive the stream in one or the other of the two distribution grooves. The spray plate is caused to rotate on the shaft about the first axis in a direction dependent upon which groove receives the stream, which, in turn, is dependent upon the direction of tilt of the spray plate about the second axis.

The distribution grooves have generally vertically oriented inlets and generally horizontally oriented outlets, and the grooves may be covered by a correspondingly shaped "shield" that confines the stream in the respective grooves.

The spray plate cage, as noted above, is secured to one end of a rotatable shaft, and the other end of the shaft may be secured within a viscous retarder "motor" of the type described in commonly owned U.S. Pat. Nos. Re. 33,823; 5,058,806; and 5,288,022, for controlling the speed of rotation of the spray plate. The cage also supports a horizontally extending shift lever for free rotation about a third axis that is parallel to the first vertical axis. The shift lever is formed with a generally round-shaped aperture that is arranged so that the stream emitted from the nozzle passes through the aperture, upstream of the spray plate grooves. The shift lever is pivotable between a pair of tabs on the spray plate cage and, as explained in greater detail below, serves to deflect the stream sufficiently to cause the spray plate to tilt and thus allow the stream to move from one to the other of the two grooves and thereby reverse the rotation direction of the spray plate.

A generally cylindrically shaped stop assembly is also secured to the sprinkler cap, above the nozzle and surrounding at least a portion of the spray plate cage and the shift lever. The stop assembly includes a first ring component having a first receiving stop formed in an interior surface thereof. A second ring component of the stop assembly is mounted on the first ring component and includes a second reversing stop that is rotationally adjustable relative to the first stop, it being understood that the arcuate distance between the stops (and through which the outer end of the shift lever travels) determines the arc through which the spray plate rotates. Specifically, the shift lever rotates with the stop assembly about the first axis until it contacts one of the reversing stops. Then while the spray plate continues to rotate, the shift lever is forced to rotate about the third axis, moving from is center position and engaging the stream thus shifting the stream away from the spray plate center barrier. This then causes the spray plate to tilt, resulting in a reversal of the direction of rotation of the spray plate.

In a second and presently preferred embodiment, the viscous retarder motor is incorporated into the sprinkler body, upstream of the nozzle. This arrangement essentially eliminates the cap and motor shaft as well as a significant portion of the spray plate cage as described above. In this embodiment, the sprinkler body includes a fixed outer housing that supports a stator housing or sleeve for rotation about a fixed rotor stem that, in turn, supports the nozzle. The stator housing or sleeve mounts a vertically extending spray plate support that pivotally mounts the spray plate for tilting movement in a manner similar to that of the first described embodiment. The shift lever is supported directly on the stator housing, while first and second rings and associated first and second reversing stop posts are adjustably supported on the outer housing.

Viscous fluid is introduced between the stator housing and fixed rotor stem and acts to retard the speed of rotation of the stator housing and spray plate relative to the speed of rotation that would otherwise result from the impingement of the stream on the curved water emitting grooves in the spray plate In its broader aspects, therefore, the invention relates to a reversible, adjustable arc sprinkler head comprising a sprinkler body incorporating a fixed nozzle; a spray plate mounted on one end of a support cage for rotation with the support cage in one or the other of two opposite directions about a first axis arranged coaxially with a stream emitted from the nozzle, and for back and forth tilting motion about a second axis perpendicular to the first axis, an opposite end of the support cage secured to a sleeve rotatably mounted in the sprinkler body, the spray plate having a pair of substantially parallel grooves for selectively receiving the stream, wherein the direction of rotation of the spray plate about the first axis is determined by the tilting motion of the spray plate about the second axis; and a shift lever formed with an aperture sized to receive the stream, the shift lever mounted at one end on the sleeve for rotation about a third axis parallel to the first axis, the shift lever enabled to shift the stream from one of the pair of grooves to the other of the pair of grooves to thereby reverse the direction of rotation of the spray plate.

In another aspect, the invention relates to a reversible, adjustable arc sprinkler head comprising a sprinkler body having an outer housing, a rotatable stator housing supported within the outer housing, and a fixed, hollow rotor stem secured to the outer housing and located radially inward of the stator housing, the rotor stem supporting an axially arranged nozzle; a spray plate mounted in a cage for tilting motion relative to the cage about a horizontal axis; the cage and spray plate mounted at one end on the stator housing for rotation relative to the sprinkler body about one vertical axis, the spray plate having formed therein a pair of substantially parallel grooves adapted to be sequentially aligned with the nozzle for receiving a stream from the nozzle, wherein the direction of rotation of the spray plate about the first axis is determined by the tilting motion of the spray plate about the second axis; a shift lever extending substantially horizontally and mounted on the stator housing for confined pivotal rotation about another vertical axis, parallel to the one vertical axis, the shift lever having an inner portion with an aperture therein through which a stream emitted from the nozzle may pass; and a stop assembly mounted on the outer housing and including a first annular ring provided with a first stop post, and a second annular ring supported on the first annular ring for rotation relative to the first annular ring, the second annular ring having a second stop post adjustable relative to the first stop post; and wherein the shift lever is arranged to rotate with the stator housing, the cage and the spray plate about the one vertical axis between the first stop post and the second stop post, and to rotate about the another vertical axis after engagement with one of the first stop post and the second stop post.

The invention will now be described in detail, in connection with the drawing figures identified below.

DETAILED DESCRIPTION OF THE INVENTION

Figure 1:
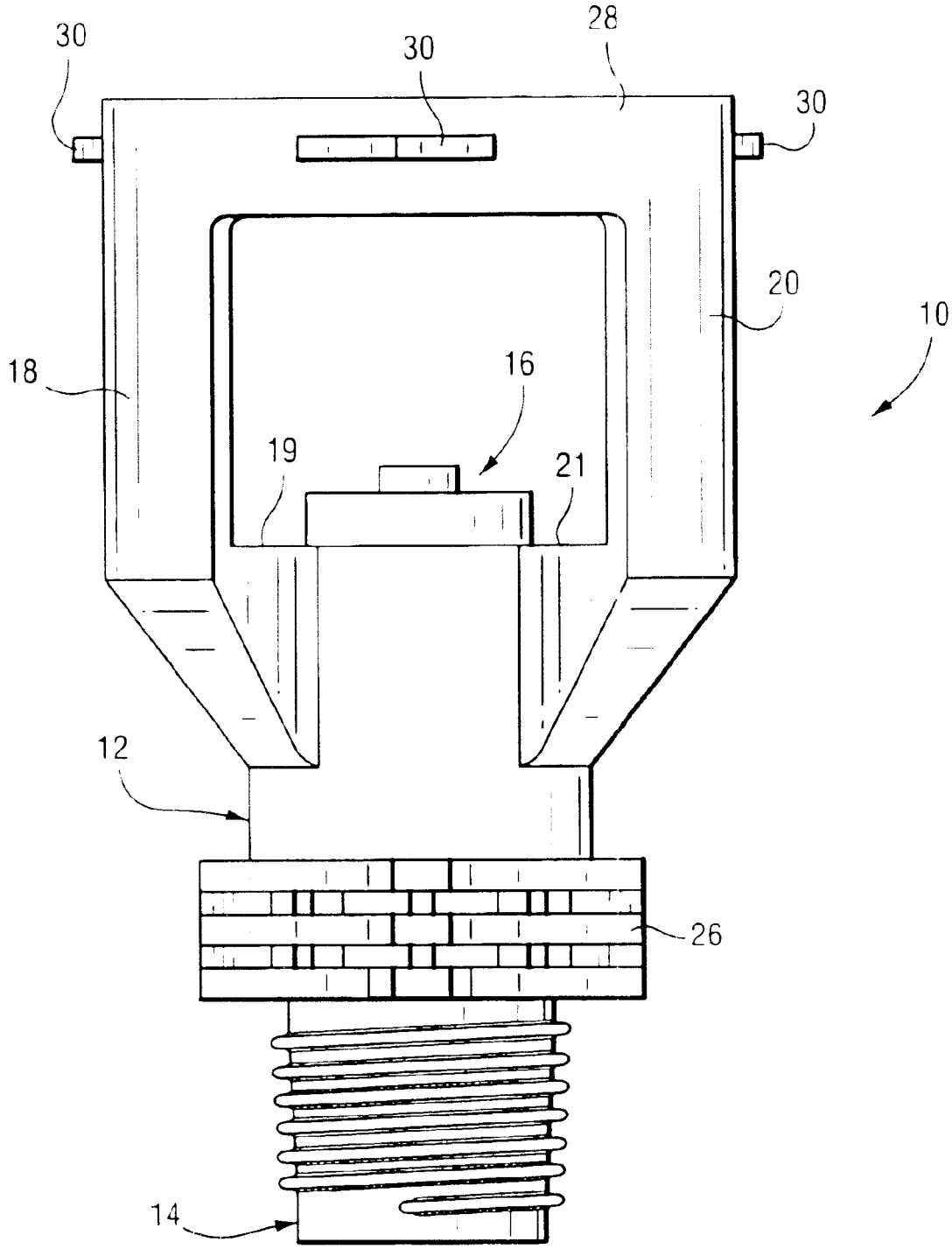
FIG. 1 is a side elevation of a sprinkler head, with parts removed for clarity.
Figure 2:
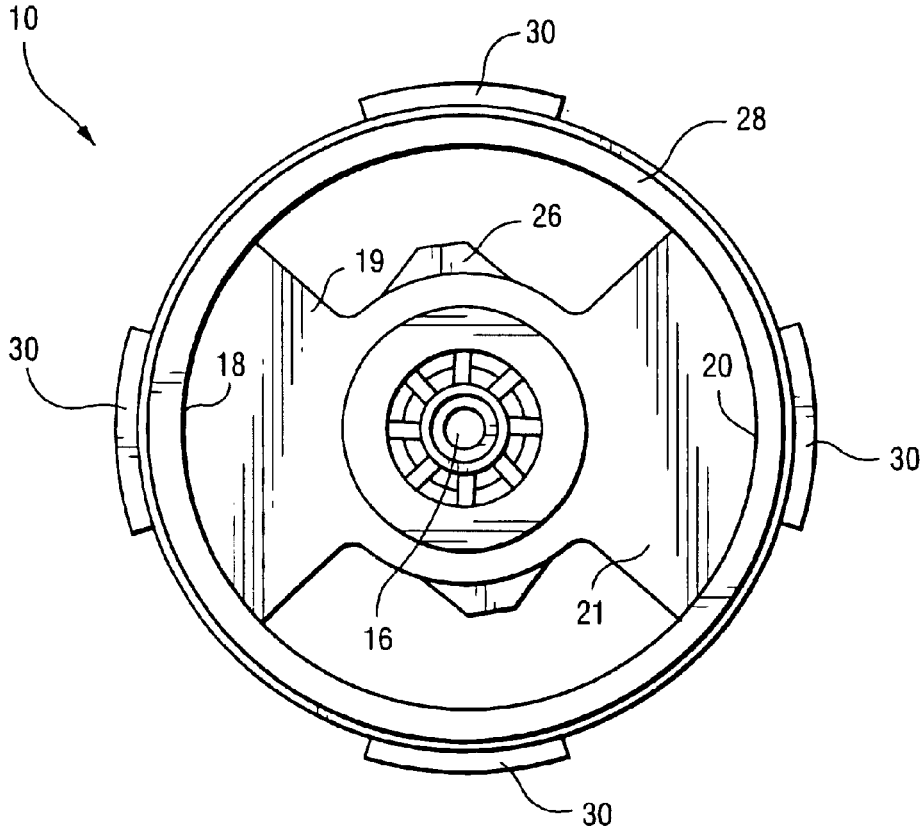
FIG. 2 is a plan view of the sprinkler head shown in FIG. 1.
Figure 4:
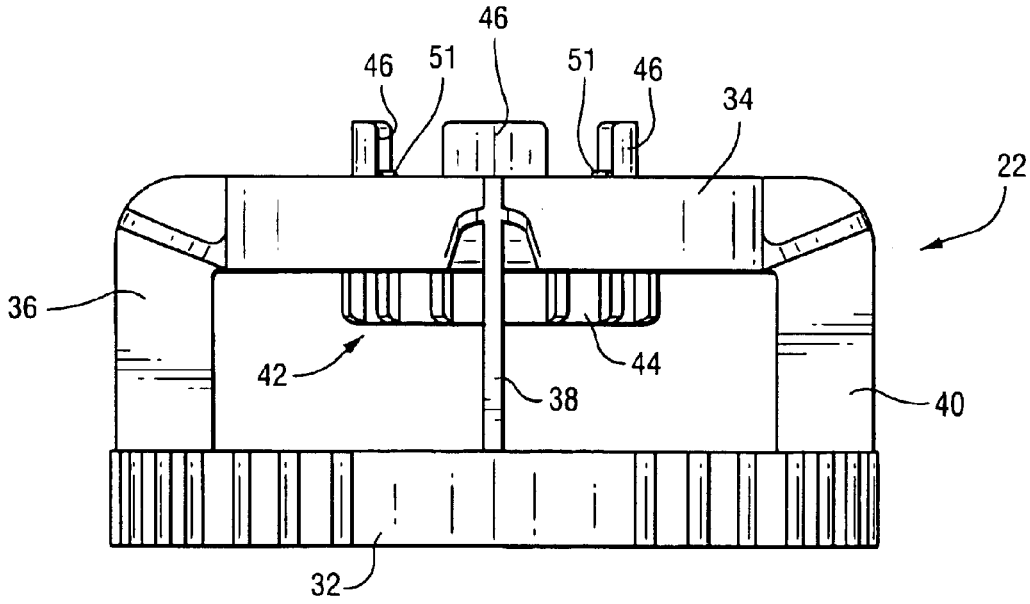
FIG. 4 is a side elevation of a cap component for the sprinkler head shown in FIG. 1.
Figure 3:
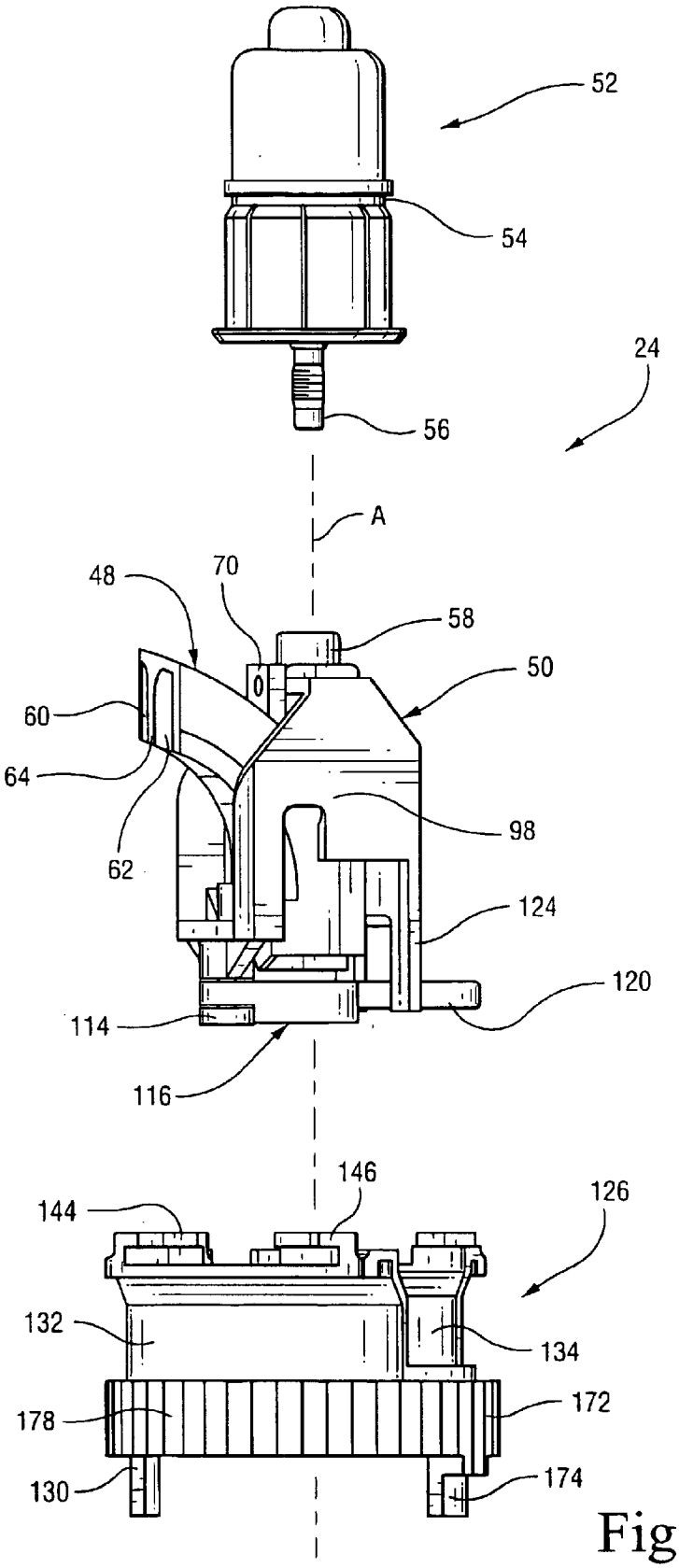
FIG. 3 is an exploded elevation, illustrating a spray plate assembly and a stop assembly for attachment to the cap shown in FIG. 4.
Figure 5:
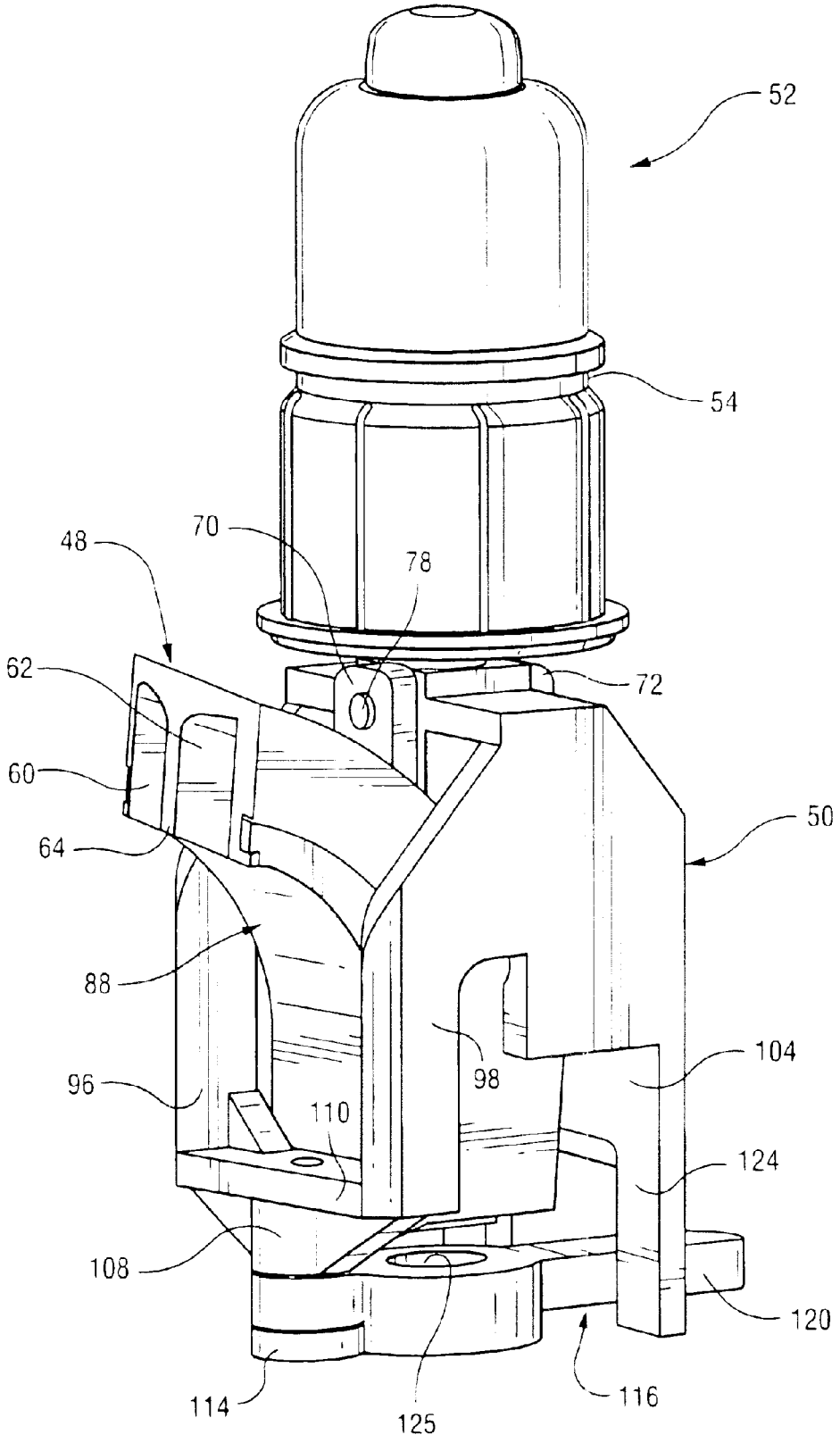
FIG. 5 is a perspective view of the spray plate assembly including a retarder motor, spray plate and spray plate cage in assembled relationship.
Figure 6:
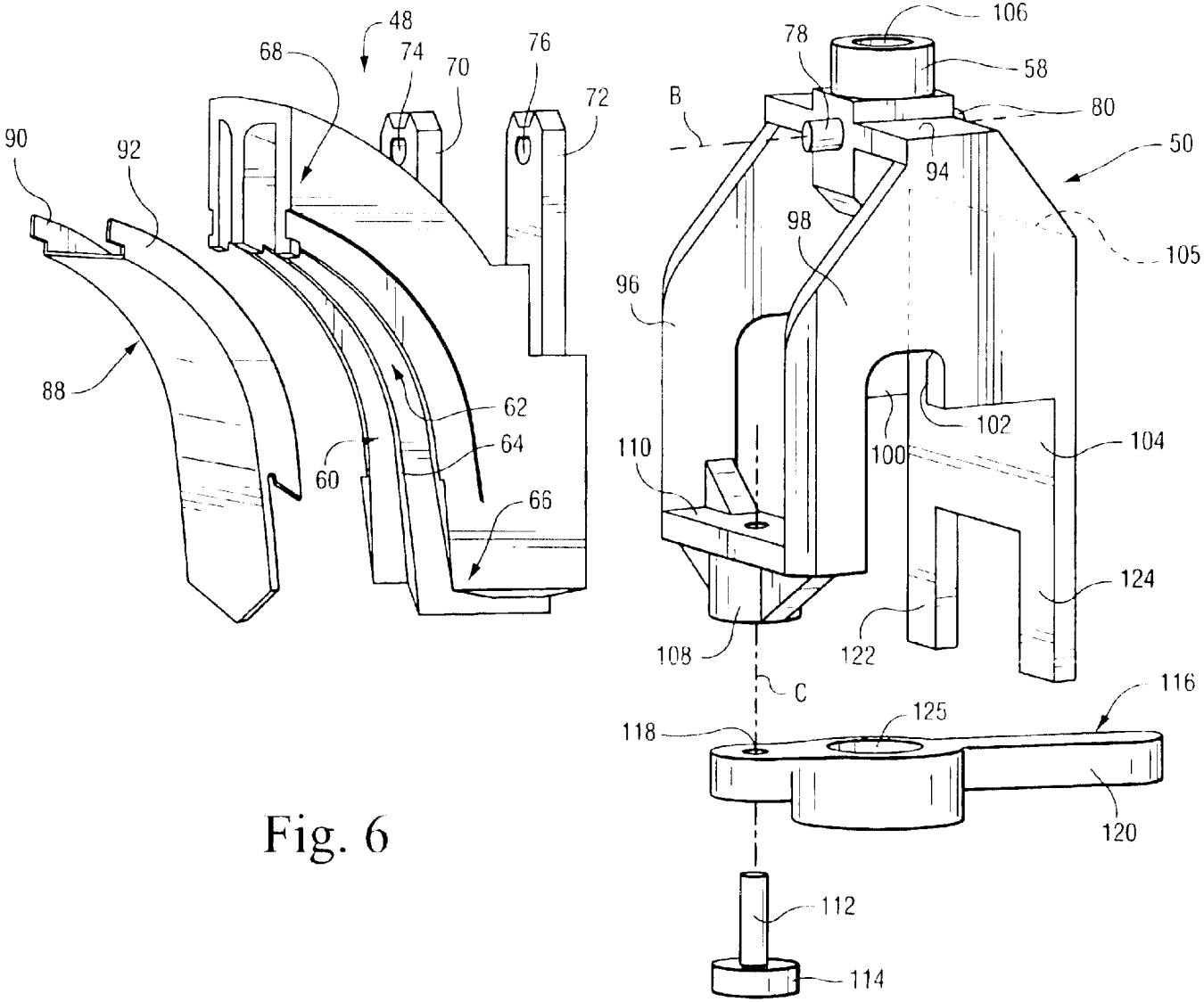
FIG. 6 is an exploded perspective view of the spray plate and spray plate cage for use with the sprinkler head shown in FIG. 1.
Figure 8:
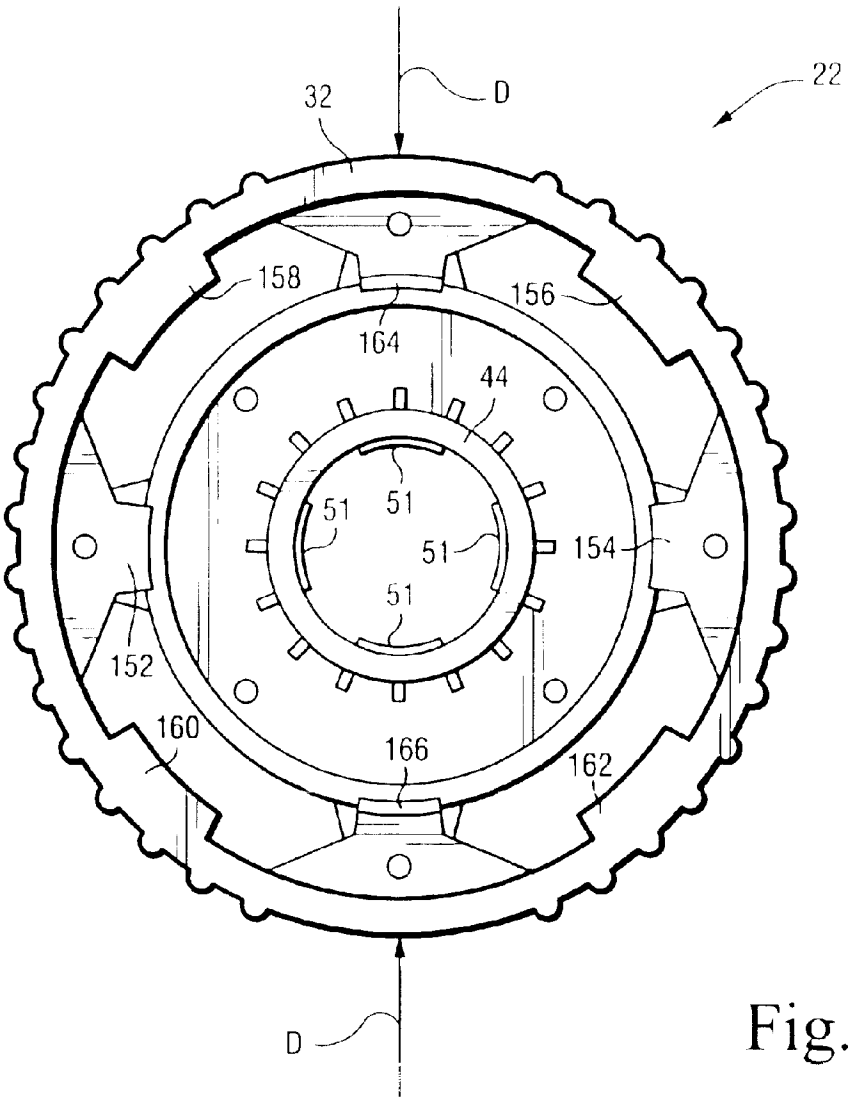
FIG. 8 is a bottom plan view of the cap shown in FIG. 4.
Figure 15:
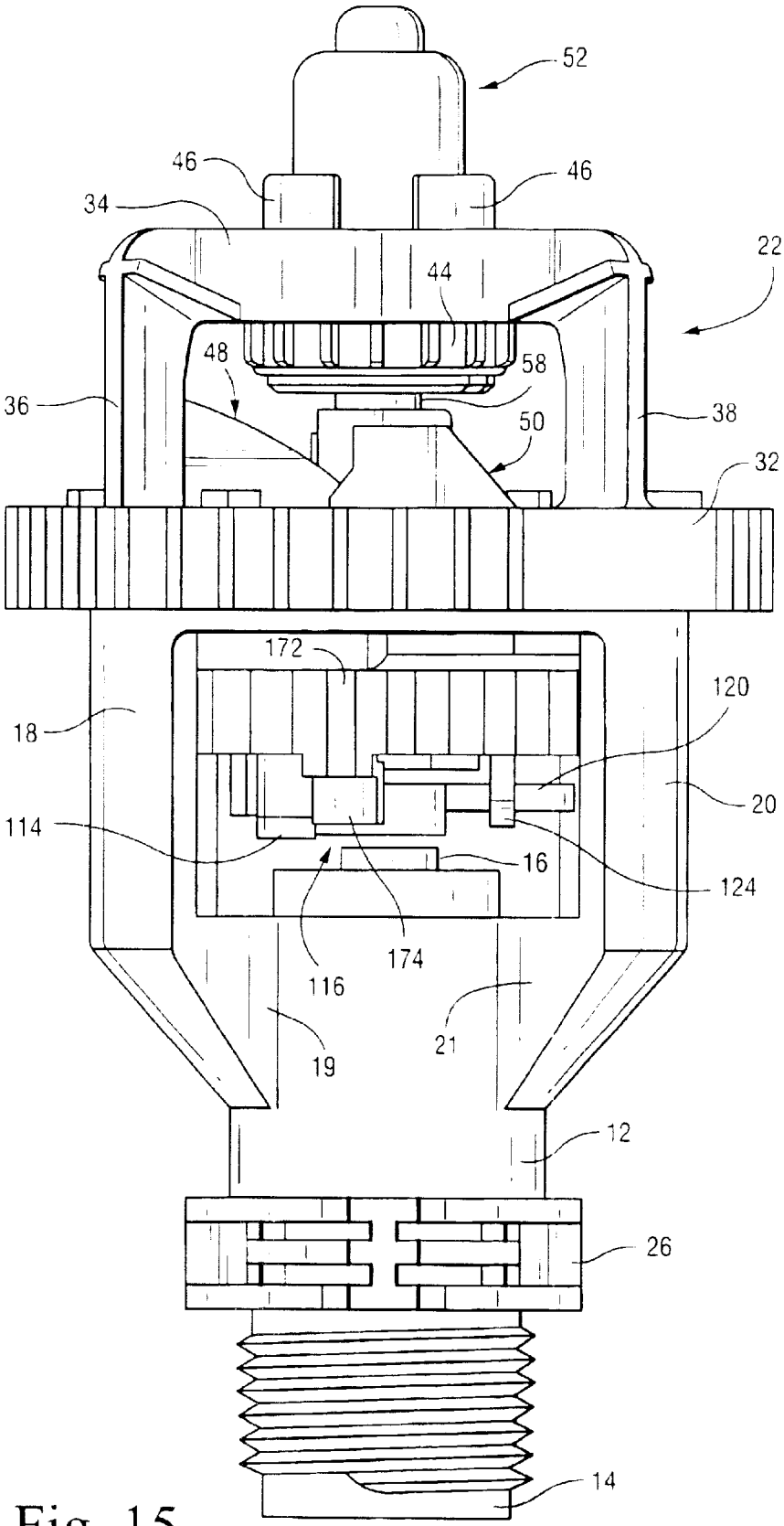
FIG. 15 is a front elevation of an assembled sprinkler head in accordance with the invention.
Figure 16:
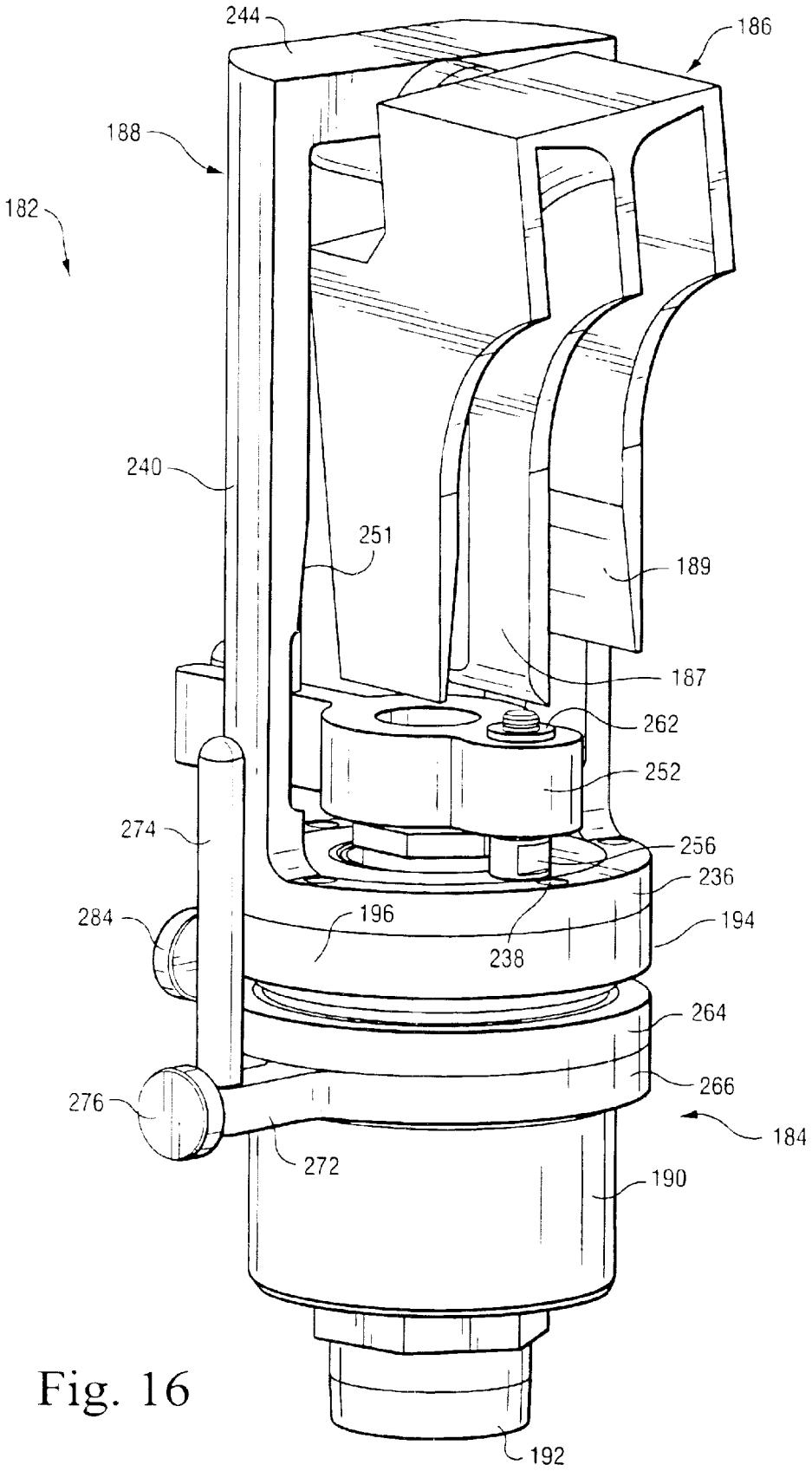
FIG. 16 is a perspective view of a sprinkler head in accordance with another embodiment of the invention.

With reference to FIG. 1, a sprinkler head 10 in accordance with a first exemplary embodiment is illustrated in part, showing a sprinkler body 12 including an inlet 14 and a nozzle 16 that is arranged to emit a single stream coaxial with the longitudinal axis of the sprinkler head. The sprinkler body 12 is provided with a pair of upstanding struts or supports 18 and 20 that extend upwardly from respective radially outwardly extending base portion 19 and 21. The struts 18, 20 are adapted to mount a cap 22 (see FIGS. 4, 8 and 15) that supports a rotatable spray plate assembly 24 and a stop assembly 126 (FIG. 3). The inlet 14 is adapted to be secured to a water supply component such as a fixed riser or the like. An integral nut 26 can be utilized to thread the sprinkler head onto the water supply component.

The struts 18, 20 terminate at an annular ring 28 provided with a plurality of radially outwardly directed tabs 30 by which the cap 22 can be secured in a known fashion, e.g., in a press and twist configuration.

The cap 22 (FIG. 4) includes a lower annular ring 32 and an upper annular ring 34 connected by four upstanding struts (three of which are shown at 36, 38 and 40) on 90° spacing. The upper annular ring 34 is formed with an integral center hub 42 that includes an annular ring 44 on the underside of the hub, and a plurality of upstanding tabs 46 on the upper side of the hub. The hub 42 supports the spray plate assembly 24 shown in exploded view in FIG. 3. The spray plate assembly 24 includes a spray plate 48, a spray plate cage 50, and a viscous retarder motor 52. The viscous retarder motor 52 slows the speed of rotation of the spray plate 48 as described further herein, and may be constructed as disclosed in commonly owned U.S. Pat. Nos. Re. 33,823; 5,058,806 and 5,288,022. The retarder motor 52 is press fit and snapped into place within the hub 42 of the cap 22, with a lower portion of the motor engaged by annular ring 44 and a middle portion of the motor engaged by the tabs 46. The latter may be formed with horizontally oriented ribs 51 (FIGS. 4 and 8) on interior surfaces thereof that are engaged in the groove 54 in the motor housing. A motor shaft 56 is received in a bushing 58 on the spray plate cage 50 so that the spray plate cage and spray plate rotate about a first vertical axis A coincident with shaft 56, and is slowed by the viscous retarder motor 52. Axis A is also coincident with the longitudinal axis of the sprinkler body, passing through the center of nozzle 16.

With reference also to FIGS. 5, 6, 9 and 10, the spray plate 48 is formed with a pair of side-by-side parallel grooves 60, 62 separated by a center wall or barrier 64. The grooves are generally vertically oriented at an inlet end 66 thereof, but transition to an almost horizontal orientation at an outlet end 68 (see FIG. 6). The spray plate 48 is also formed with a pair of vertically oriented, aligned mounting tabs 70, 72 having apertures 74, 76, respectively, by which the spray plate is pivotally mounted on a pair of aligned pins 78, 80 on the spray plate cage 50, for swinging movement about a horizontal axis B defined by the pins 78, 80.

The inlet end 66 of groove 60 is flared at 84, and the center barrier 64 is chamfered at 86 so that, on start-up, more of the stream emitted from nozzle 46 will enter groove 60 than 62, causing the spray plate to tilt about axis B, resulting in all of the stream flowing into groove 60. Because the stream exit point for the groove 60 is offset from the axis of rotation A of the plate, the plate will rotate about axis A to distribute the stream in a part circular pattern. This action will be described in greater detail below.

A cover or shield 88 (FIG. 6) including side walls 90, 92 may be snapped into place over the open faces of the grooves 60, 62 to confine the stream to the grooves between the inlet and outlet ends 66, 68.

The spray plate cage 50 that carries the spray plate 48 includes a top surface 94 and a pair of side walls 96, 98 that confine movement of the spray plate 48 on the pins 78, 80. Specifically, the spray plate 48 is free to tilt back and forth between two stop surfaces 100, 102 (best seen in FIG. 10) of the side walls 96, 98. Note that the back wall 104 is open in the area above reference number 105, allowing the tab 72 to be attached to the pin 80.

The bushing 58 extending above the top surface 94 includes an aperture 106 that receives the retarder shaft 56 in a friction, spline or other suitable fit.

A second bushing 108 projecting from a lower bar 110 extending between the side walls 96, 98 is formed with a blind bore for receiving a pivot pin 112 formed with an integral head 114 that serves to mount a shift lever 116 via hole 118 for rotation about a second vertical axis C coincident with the pin 112. An extended lever portion 120 of the shift lever 116 is thus free to move back and forth between a pair of depending tab stops 122, 124 at the lower end of the back wall 104. An aperture 125 in the shift lever interacts with the stream emitted from the nozzle as explained further herein.

Figure 7:
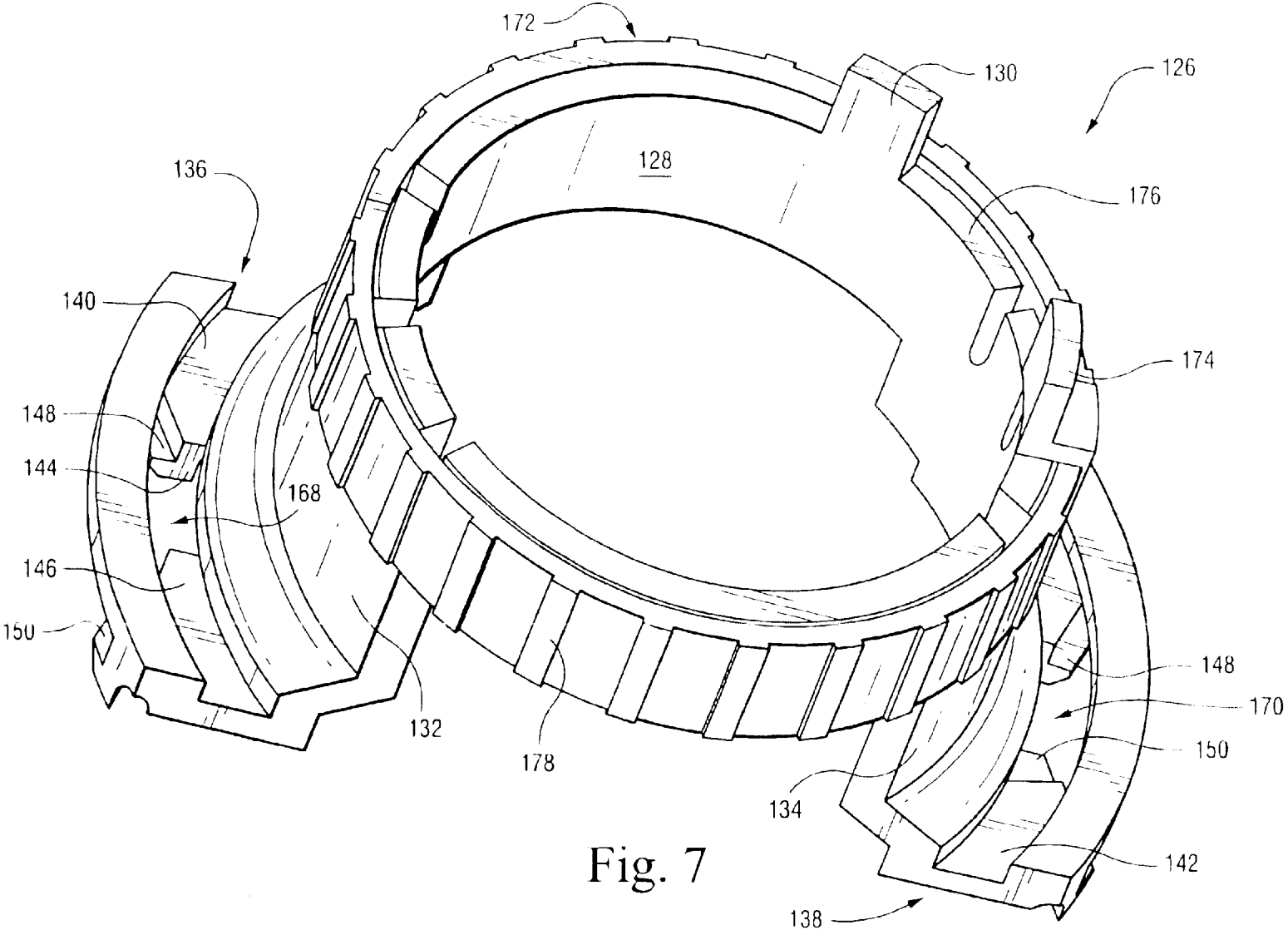
FIG. 7 is an inverted perspective view of the stop assembly shown in FIG. 3.
Figure 14:
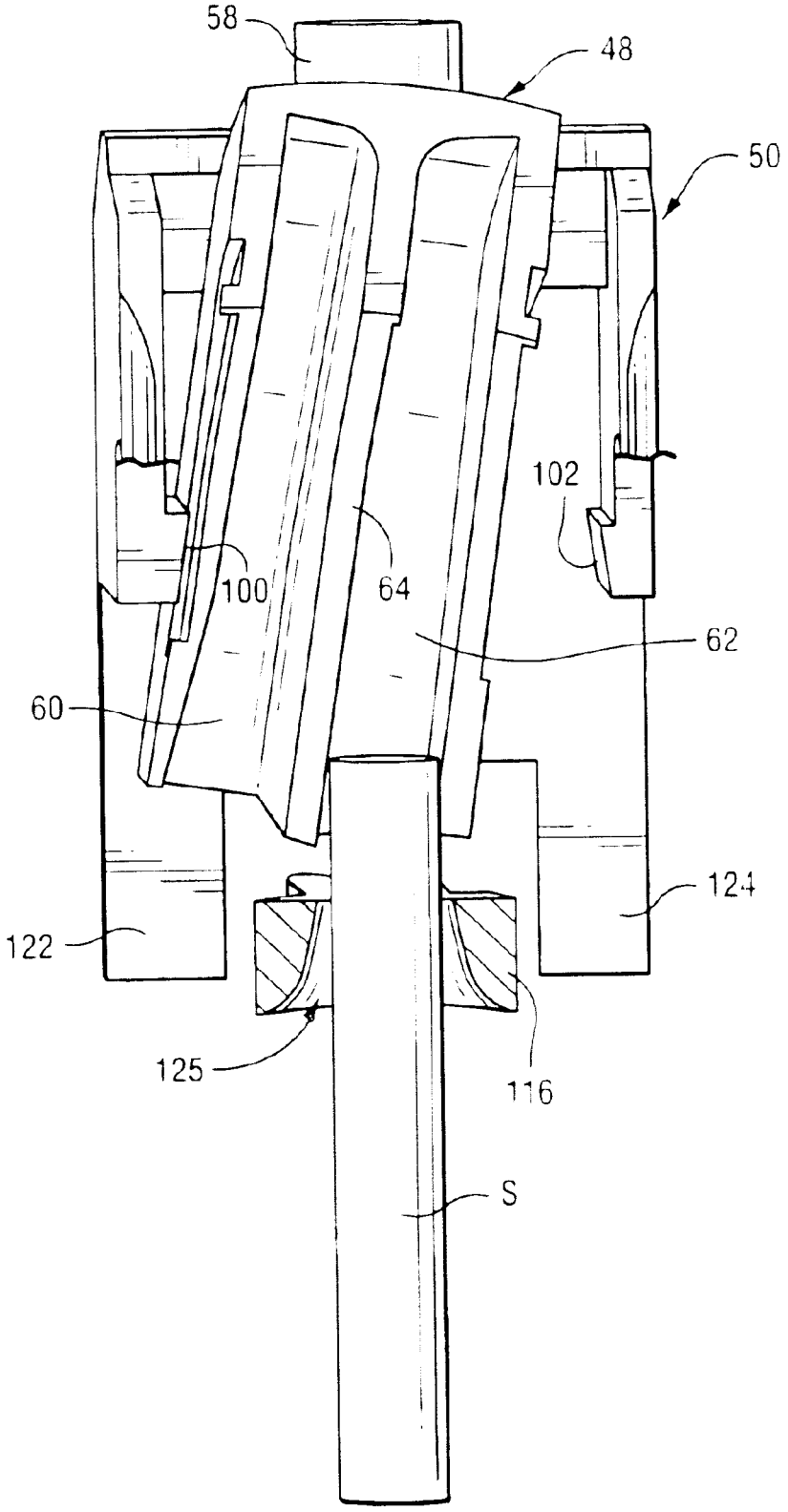
FIG. 14 is a front elevation similar to FIGS. 10, 11 and 13, but illustrating the stream fully shifted into the other of the two grooves.

Referring now to FIG. 3 and especially FIG. 7, the stop assembly 126 includes an inner annular ring 128 having a first fixed reversing stop 130. The annular ring 128 is also formed with a pair of diametrically opposed, part annular walls 132, 134 that terminate at radially outwardly directed attachment flanges 136, 138. These flanges are formed with grooves 140, 142, respectively, on the lower side thereof (note: in FIG. 7, the stop plate assembly is inverted from its normal orientation shown in FIGS. 3 and 14). The upper sides of the flanges 136, 138 are each formed with a pair of opposed wedge elements 144, 146 that taper inwardly and are undercut to form seating surfaces 148, 150 on each flange for receiving tabs 152, 154 on the interior of the cap ring 32 (at the upper end of the ring). Tabs 156, 158, 160 and 162 (at the lower end of the cap ring 32) cooperate with tabs 30 to secure the cap 22 to the annular ring 28 of the sprinkler body, but also assist in locating the stop assembly 126 when attaching it to the cap 22. Vertical tabs 164, 166 also force the assembler to properly locate the stop assembly for interaction with the tabs 152, 154. Squeezing the cap ring 32 at points indicated by arrows D provides the space necessary to seat the stop assembly within the cap, and apertures 168, 170 in the flanges 136, 138 permit the assembler to verify that the tabs 152, 154 are correctly seated.

The stop assembly 126 also includes an outer ring 172, telescoped over the inner ring 128, utilizing a snap fit or other suitable attachment mechanism that allows ring 172 to rotate relative to ring 128. Outer ring 172 is formed with a second, movable reversing stop 174 that is radially inwardly offset from the ring 172, such that it rides on the edges 176 of the inner ring. The user is thus able to move reversing stop 174 relative to the fixed reversing stop 130 to obtain a desired arc through which the spray plate will rotate before reversing direction. Ring 172 may be provided with circumferentially spaced ribs 178 (or other suitable surface texture) to facilitate rotation of the ring.

Figure 9:
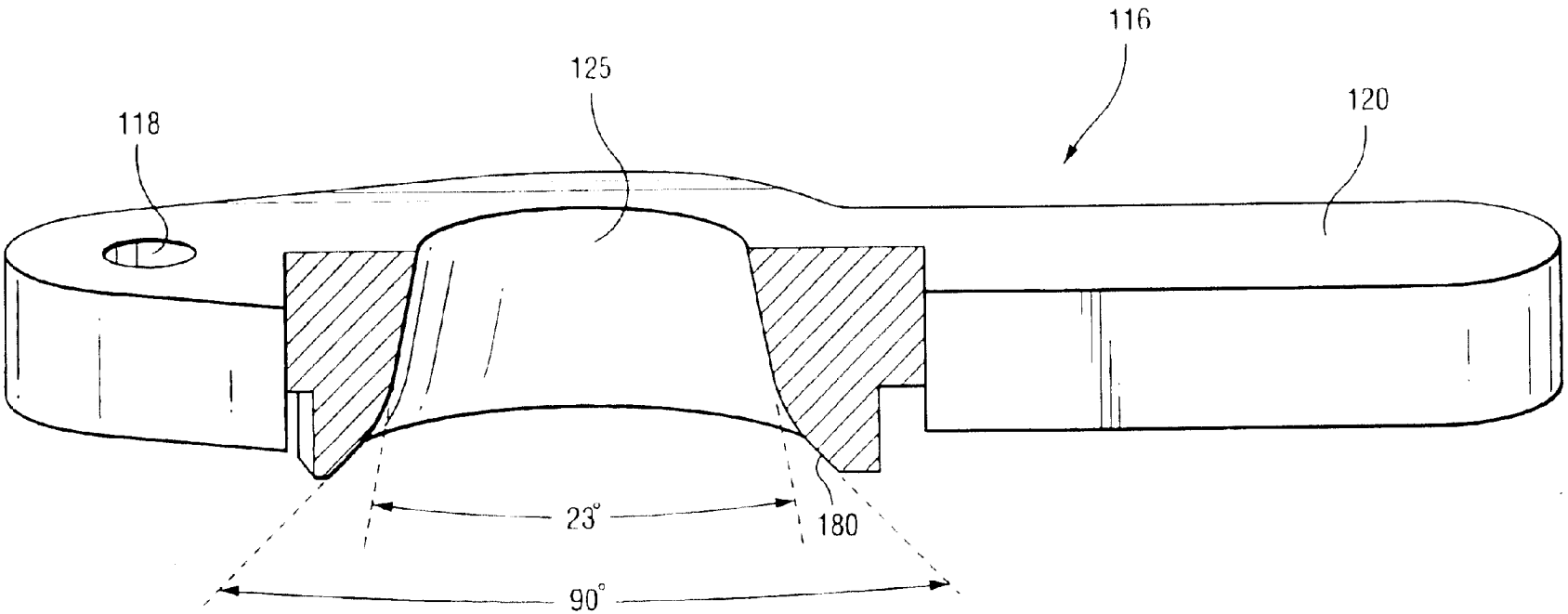
FIG. 9 is a side elevation, partly in section, of a shift lever component, taken from the spray plate cage as shown in FIGS. 4 and 5.
Figure 10:
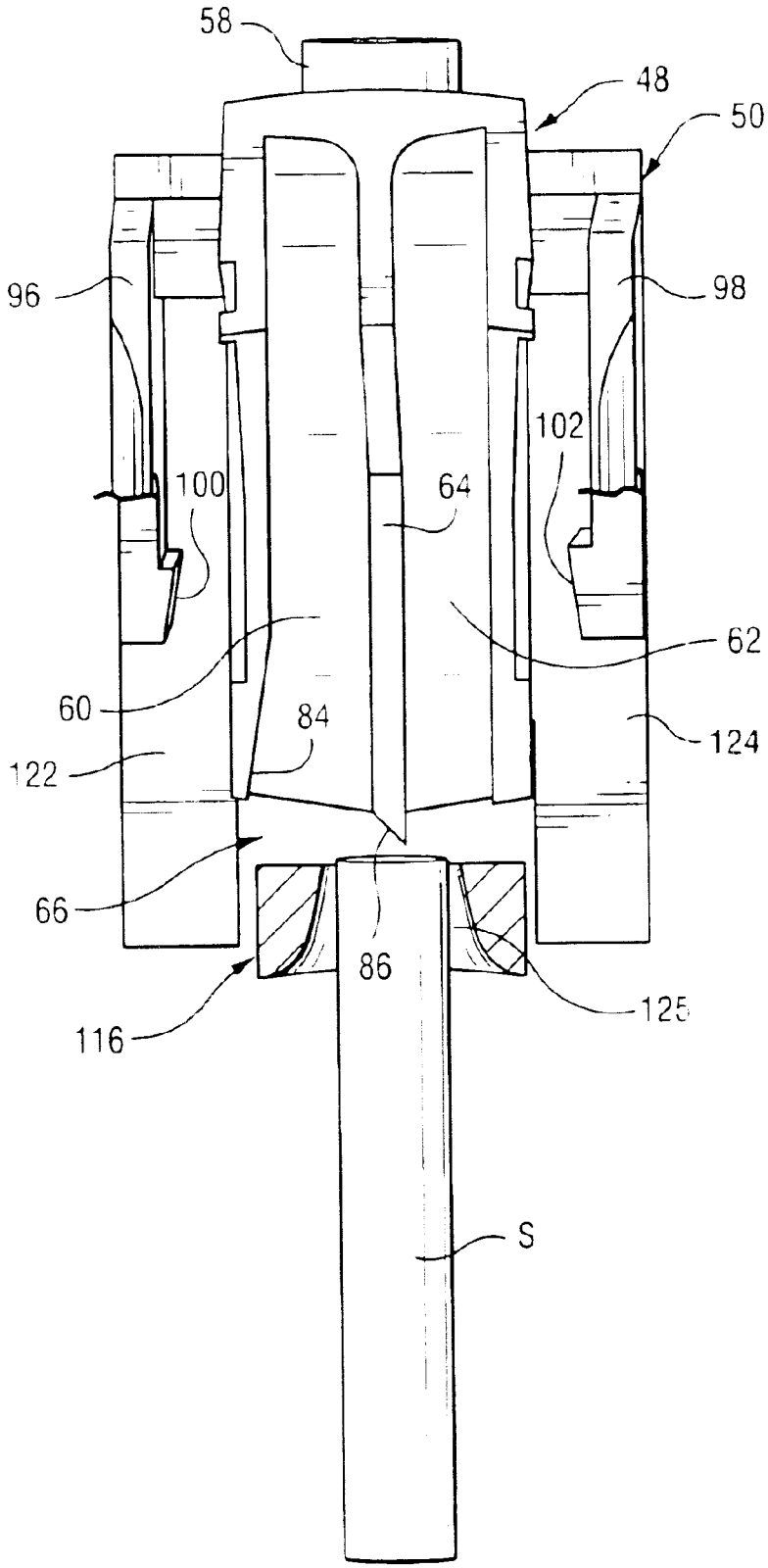
FIG. 10 is a partial front elevation, partly broken away, illustrating how a stream of water impinges on the spray plate on start-up.
Figure 11:
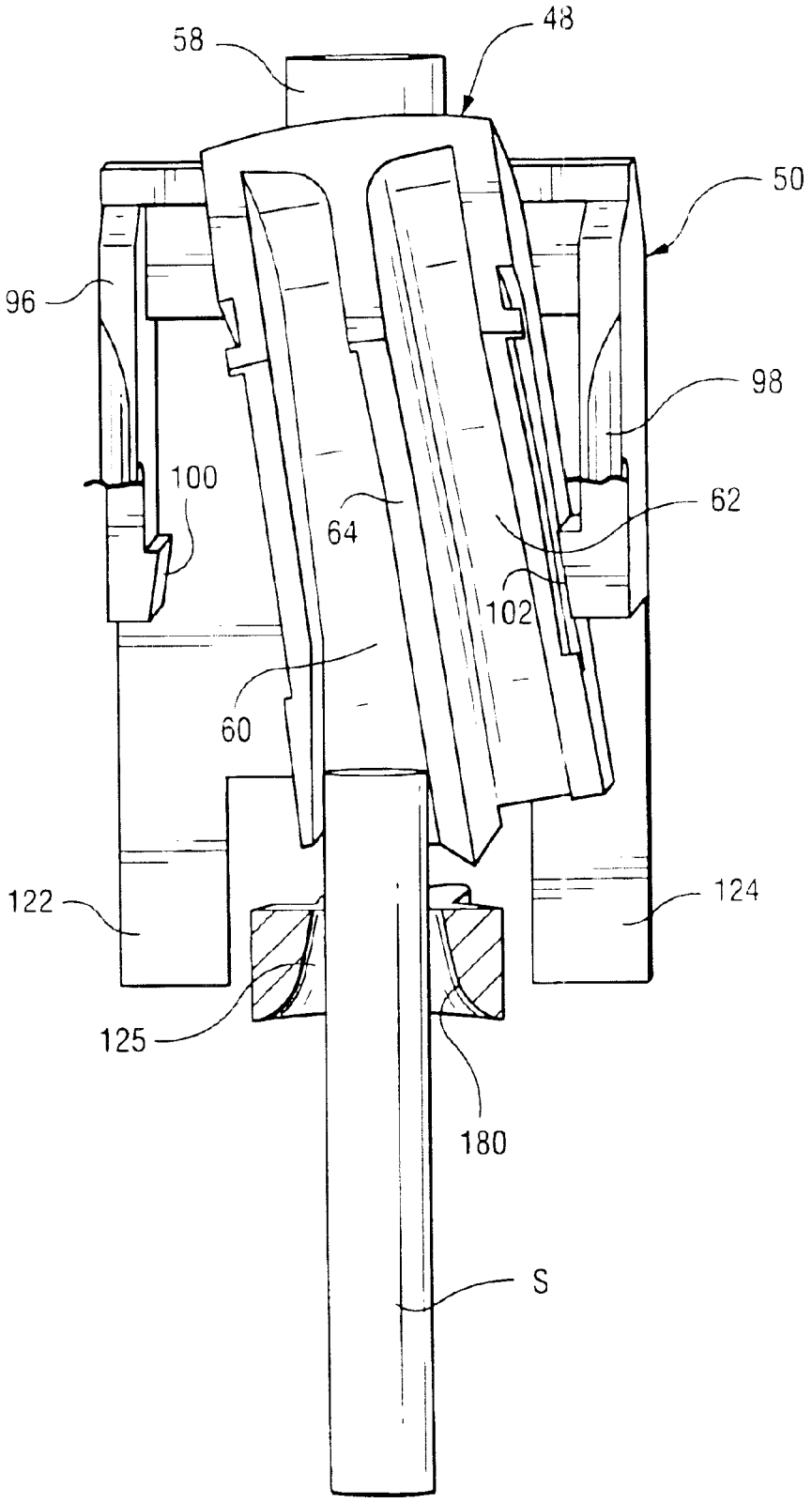
FIG. 11 is an elevation similar to FIG. 10, but illustrating the stream entering one of two grooves on the spray plate after start-up.

Before describing the operation of the sprinkler head, reference is made to FIG. 9 where the shift lever 116 is shown in enlarged form. The aperture 125 is adapted to receive a stream S emitted from the nozzle 16. The inlet to the aperture 125 is tapered as shown at 180 to facilitate entry of the stream as described below. The main portion of the aperture is tapered outwardly in a downward direction, opposed points describing an arc of about 23°. At its widest point, opposed points of the tapered inlet describe a 90° arc.

With reference now especially to FIGS. 10–14, it will be appreciated that on start-up, the stream S exiting nozzle 16 passes through the aperture 125 in the lever 116, and the aperture shape creates a venturi effect that causes the lever to "center up" around the stream. The stream initially impinges on the barrier 64 of the spray plate 58, and the beveled or chamfered edge 86 deflects more water into groove or channel 60, preventing a "null" or "equalization" of the stream that would otherwise cause the plate not to rotate, i.e., to stall. The force of the stream S entering the spray plate groove 60, and coming into contact with the side of the center barrier 64 tilts the spray plate 68 in a counterclockwise direction about axis B (FIG. 11), with the spray plate 48 engaged with stop surface 102 on the spray plate cage 50. The stream passing through the groove 60 is directed it to an offset exit position relative to the axis of rotation A of the spray plate assembly, thus causing the spray plate 48 and cage 50 to rotate about axis A in a first direction (counterclockwise as viewed in FIG. 12).

Figure 12:
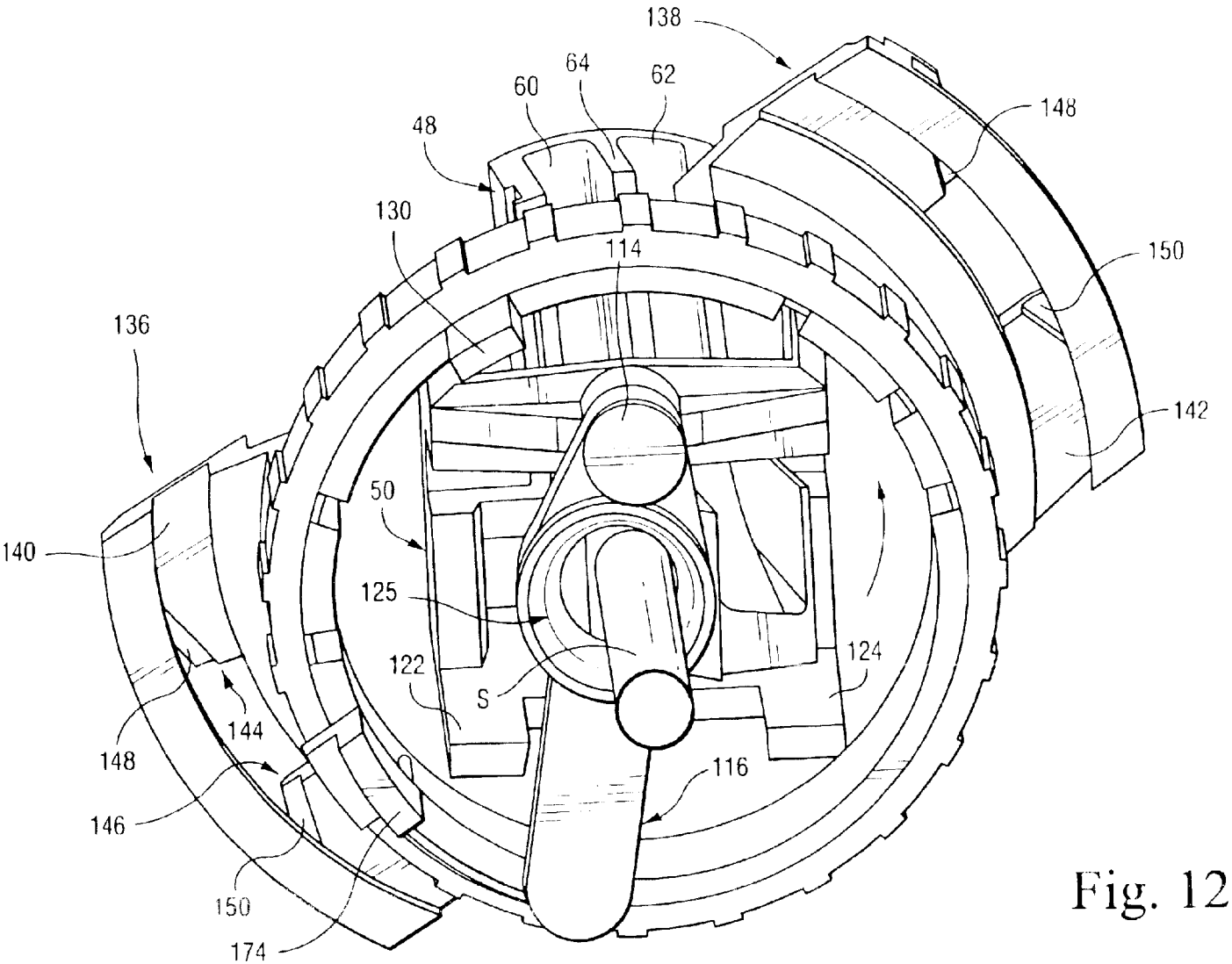
FIG. 12 is a bottom perspective view of the spray plate, spray plate cage and stop assembly in accordance with the invention.
Figure 13:
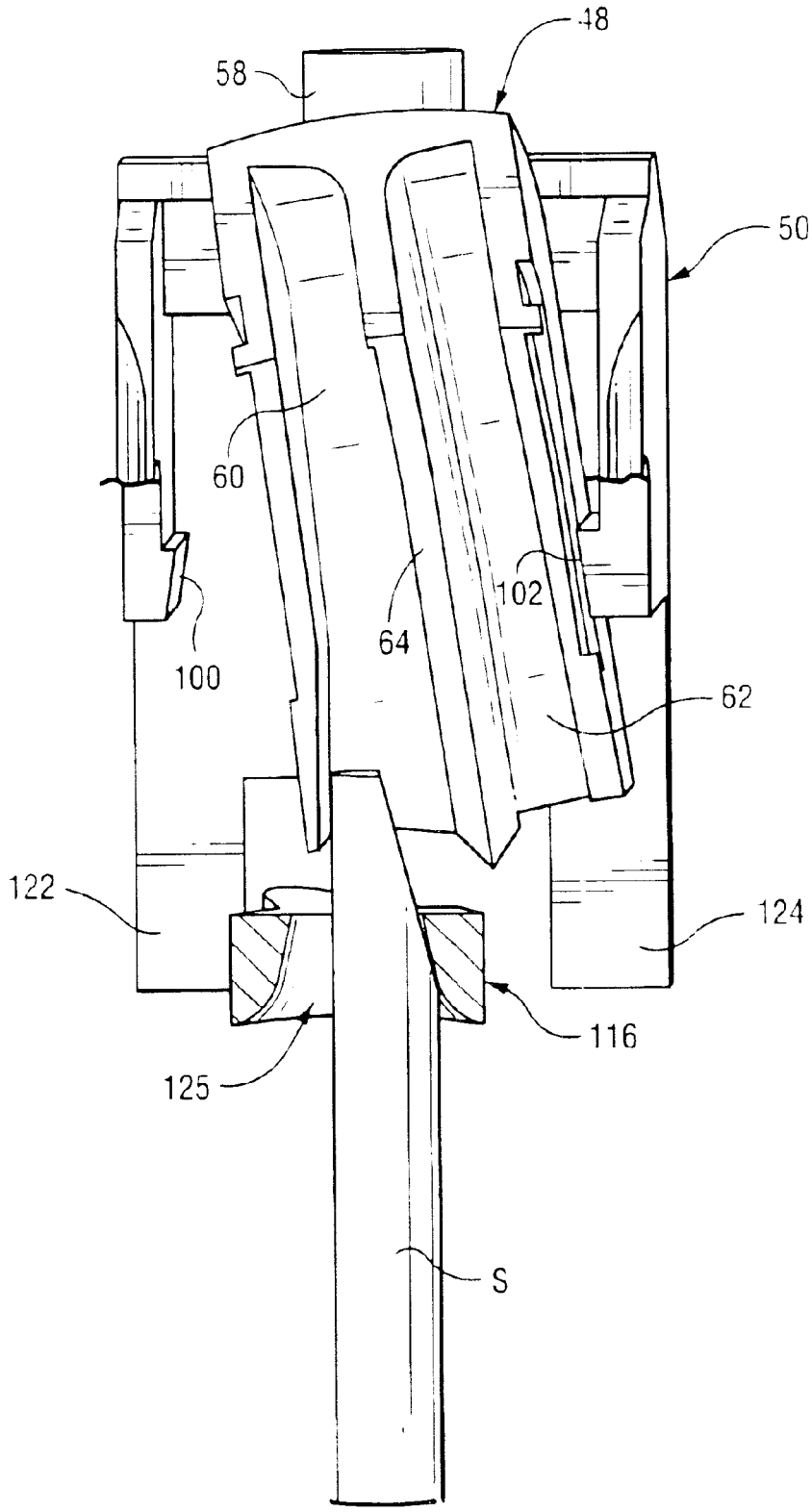
FIG. 13 is a front elevation, similar to FIGS. 10 and 11, but illustrating the manner in which the shift lever acts to shift the stream from one groove to the other.

Turning to FIG. 12, as the spray plate assembly 24 rotates about axis A, the shift lever 116 rotates with the plate about the same axis, until a remote end of the lever portion 120 comes into contact with fixed reversing stop 130. This causes the shift lever to stop rotating with spray plate 48 on axis A, and to begin rotation about axis C (pin 114). As the spray plate assembly continues to rotate, the shift lever 116 will be forced to enter the stream S (FIG. 3). As the shift lever 116 moves into the stream, it deflects the stream away from the center barrier 64, allowing the upward force created by the stream being arced outward to the offset exit point of the groove 60 to overcome the force on the center barrier. This causes the spray plate to pivot about axis B (pins 78, 80) and to tilt in a clockwise direction to the position shown in FIG. 14. Now the stream S shifts to groove 62. Once the stream enters groove 62, reversal of the direction of the spray plate 58 occurs. The shift lever 116 will remain in contact with the stream S until the spray plate 68 has shifted (i.e., until the spray plate tilts into engagement with stop 104, see FIG. 14) and the spray plate assembly has started to rotate in the opposite or reverse direction. As rotation in the opposite direction continues, the shift lever 116 will come off the stop and the venturi effect within aperture 125 will once again center up the shift lever 116 on the stream S. The lever 116 will eventually contact the adjustable reversing stop 174, and the reversing process will be repeated.

Rotation of ring 172 relative to ring 128 on the stop assembly 52 will vary the arc of coverage of the stream and thus vary the sprinkling pattern, as desired.

Turning now to FIGS. 16–20, a second exemplary embodiment of the invention relates to a sprinkler head 182 that generally includes a sprinkler body 184 and a spray plate 186 supported on the sprinkler body by a vertical spray plate or support cage 188. Except as noted below, the spray plate 186 is similar to spray plate 24 described hereinabove, including parallel grooves 187, 189. The sprinkler body 184 includes an outer, generally cylindrical housing 190 with a reduced diameter, externally threaded inlet 192 for attaching the sprinkler head to a pipe or the like. Supported concentrically within the outer housing 190 is a stator housing or sleeve 194 that has an upper radial flange portion 196 that overlies the upper edge 198 of the outer housing. A rotor stem 200 is located within the stator housing, and the lower end of the rotor stem is press fit into the reduced diameter lower end of the outer housing at 202. A conventional safety retaining ring (not shown) may be seated in the annular groove 204 in the stem to insure that the rotor stem will not be pushed out of the outer housing should excessive water pressure be encountered.

Upper and lower bearings 206, 208 are located between the rotor stem 200 and the stator housing 194 to permit the stator housing to rotate relative to the fixed rotor stem and outer housing 190 as described further below. Viscous fluid is introduced into the cavities 210, 212 below the upper bearing 206 and above the lower bearing 208 (and thus into the radial clearance between the rotor stem and stator housing), to retard rotation of the stator housing. Fluid retention seals 214, 216 are located on reduced diameter portions 218, 220 of the stem, adjacent bearings 206, 208, respectively, with bearing retention retaining rings 222, 224 axially therebetween.

A nozzle 226 is threaded into the open upper end of the rotor stem 200. The nozzle includes an upper hexagon flange 228, a 45° angle face 229, an external threaded section 230 and a pilot length portion 232. The pilot length portion 232 provides initial positioning of the nozzle in the rotor stem 200, and the external threaded section 230 will engage the internal threaded portion 231 of the rotor stem to secure the nozzle in place. The nozzle 45° angle face 229 will mate with a complimentary rotor stem 45° angle face 235 providing a face contact seal and finalizing the positioning of the nozzle. The nozzle 226 defines a discharge orifice 234 for the water stream supplied to the head 182 via inlet 192 and through the rotor.

The simplified spray plate support cage 188 includes an integral, lower annular ring portion 236 that seats on the radial flange 196 of the stator housing 194 and is secured thereto by a plurality of fastener screws 238 (or similar). The cage 188 also includes a pair of vertical supports 240, 242 connected at their upper ends by an integral, horizontal brace 244. A pivot shaft 246, press fit within the spray plate 186 is journalled in the brace 244 via pivot bearings 248, 250, for rotation about a horizontal (or second) axis that is perpendicular to a center (or first) axis of the sprinkler head 182 passing through the nozzle 226. Thus, the spray plate 186 is supported solely by the pivot shaft 246 and is free to tilt back and forth about the pivot shaft, as determined by the stream emitted from the nozzle. Sloped interior surfaces 251, 253 (FIG. 19) of the vertical supports 240, 242 provide stops that limit the tilting movement of the spray plate as in the first described embodiment.

Figure 17:
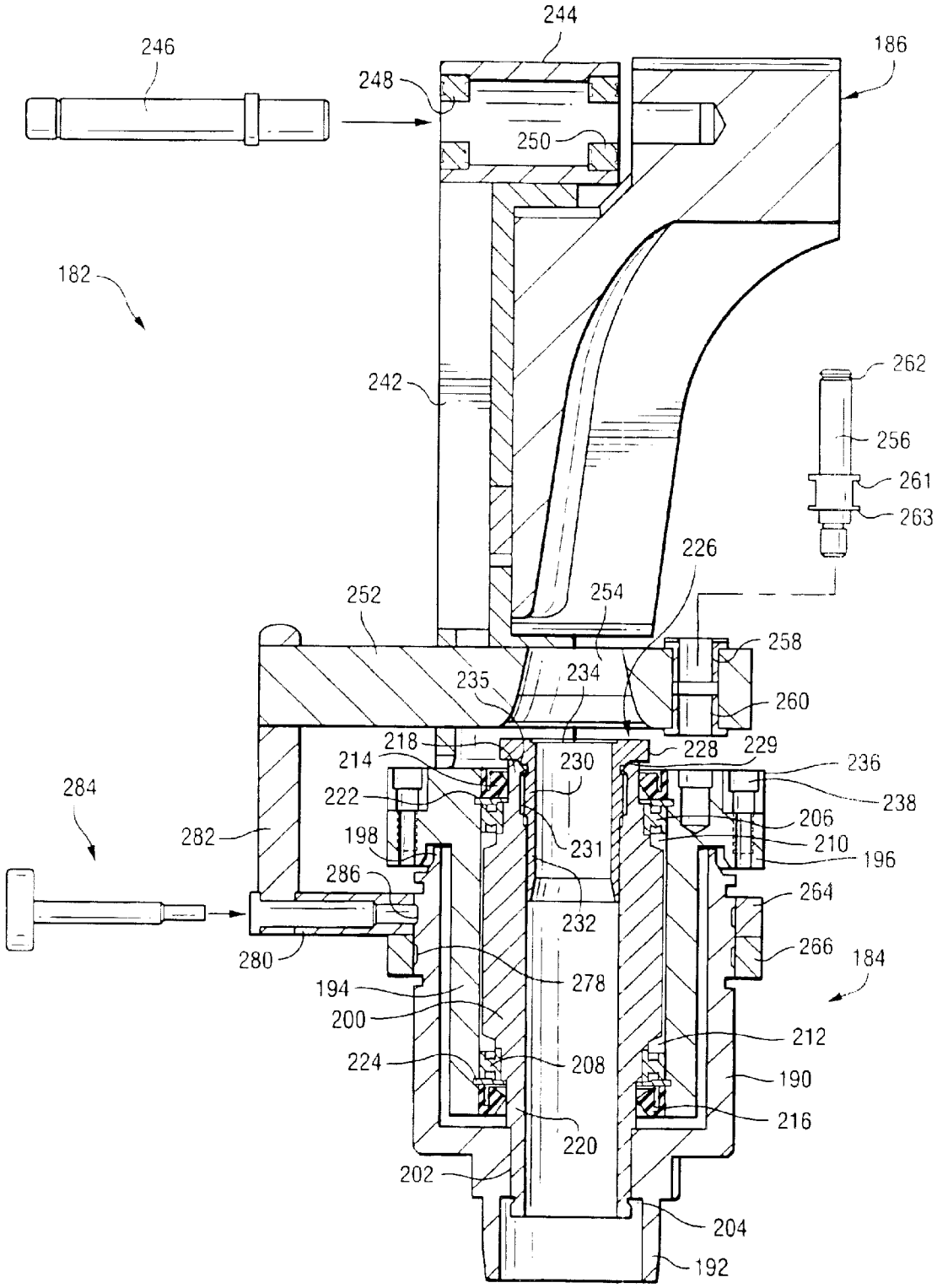
FIG. 17 is a side section of the sprinkler head shown in FIG. 16, with selected elements removed and shown in exploded form.
Figure 18:
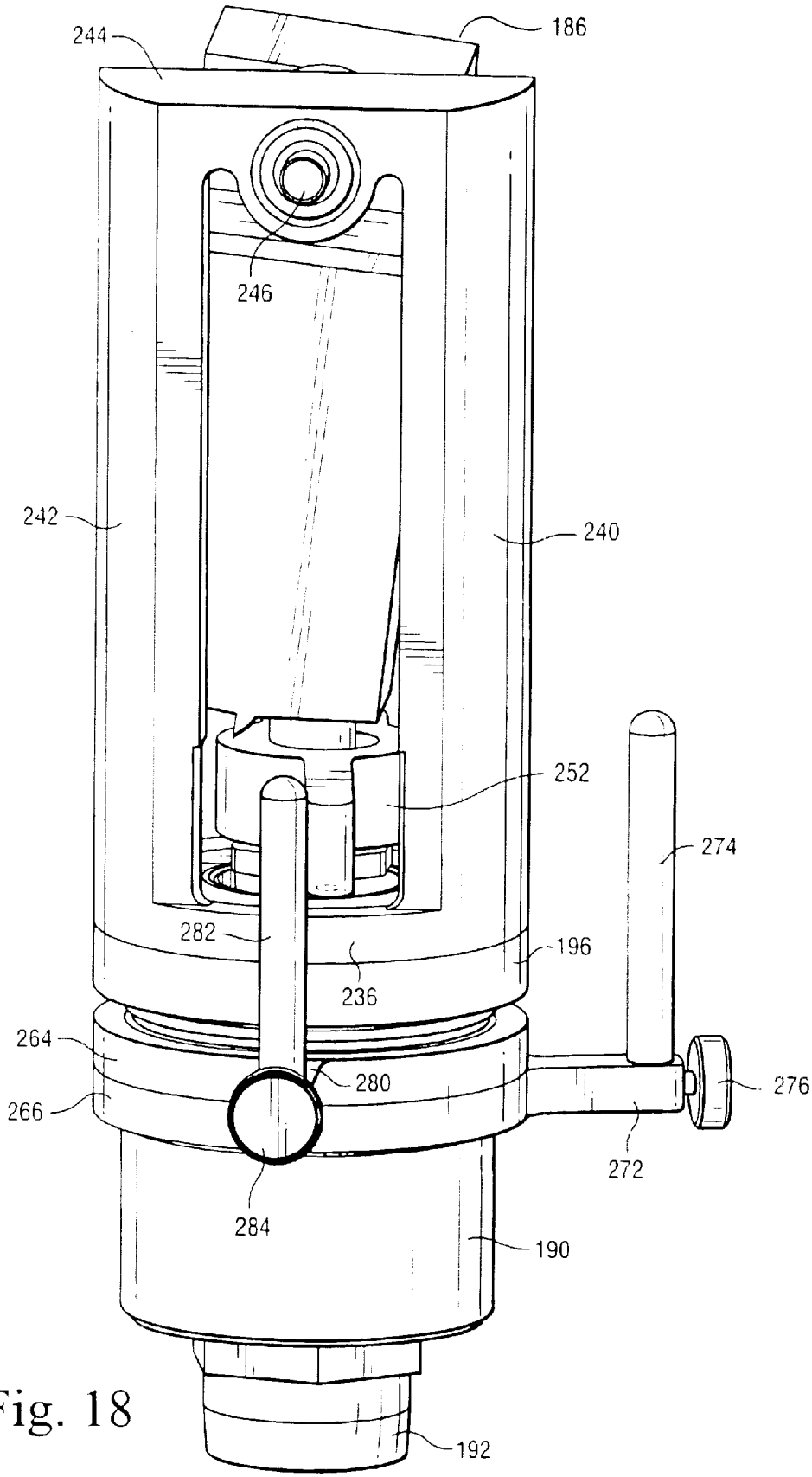
FIG. 18 is a rear elevation of the sprinkler head shown in FIG. 16
Figure 19:
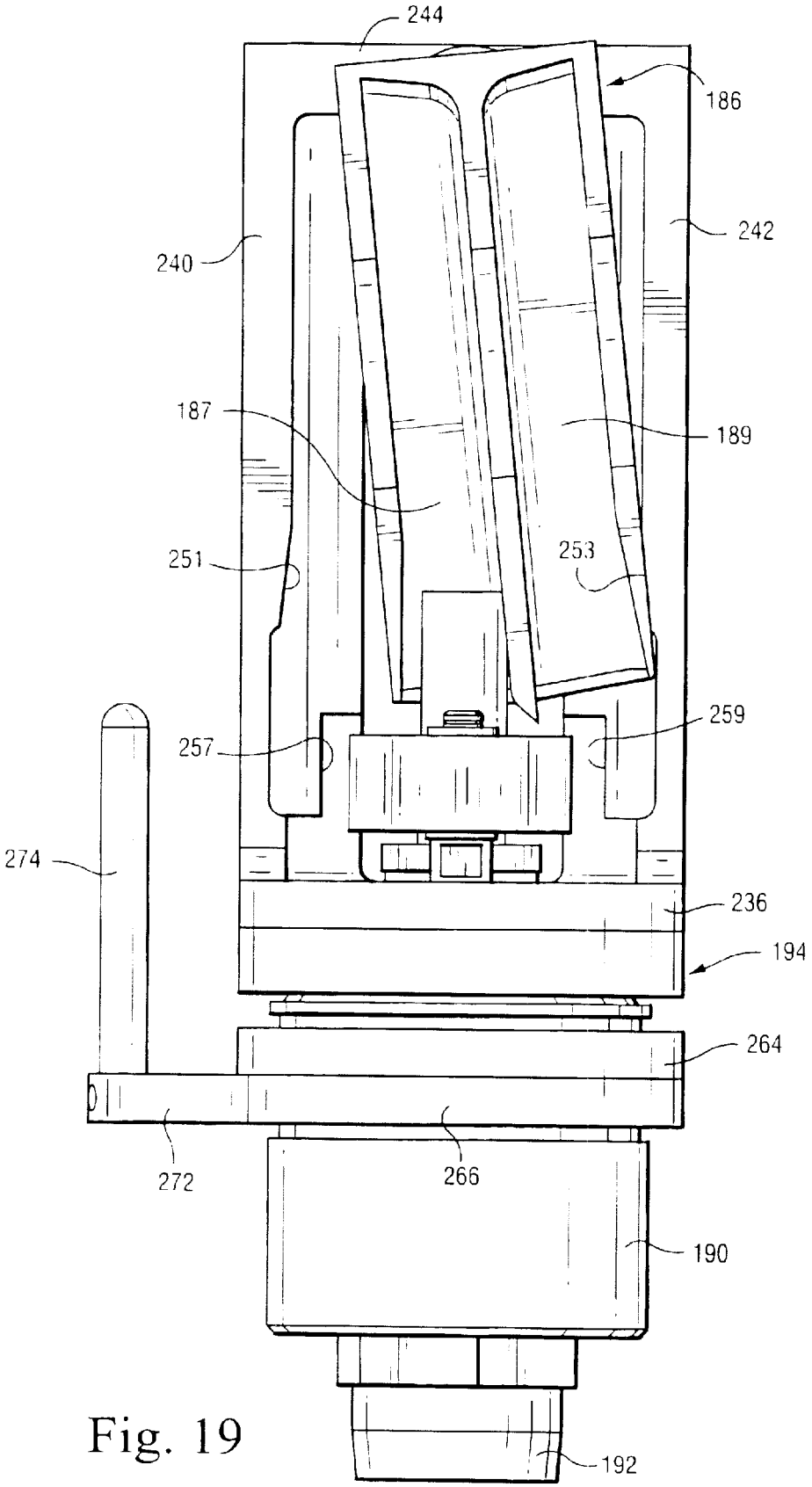
FIG. 19 is a front elevation of the sprinkler head shown in FIG. 16.
Figure 20:
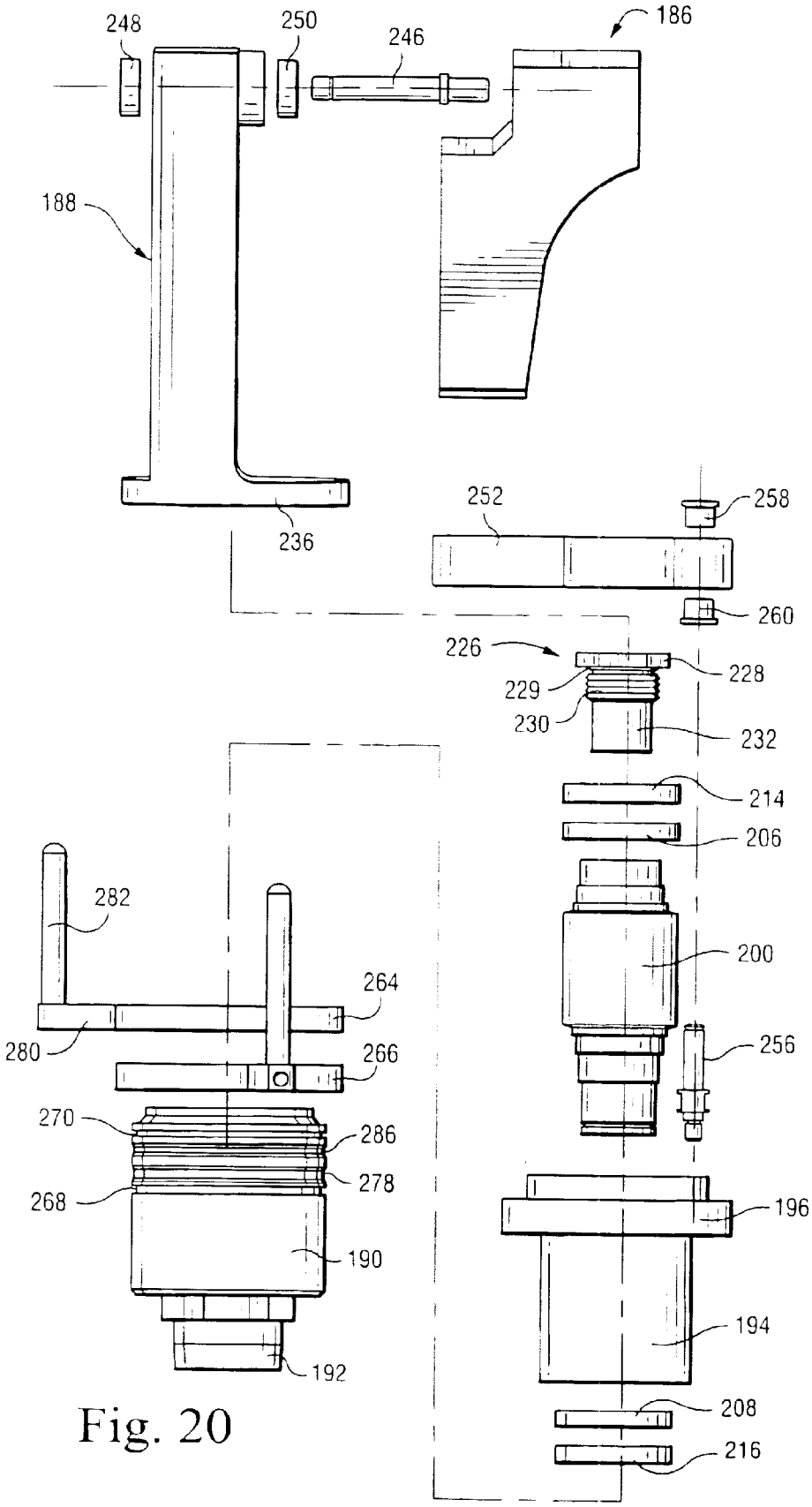
FIG. 20 is an exploded assembly view of the sprinkler head shown in FIGS. 16–19.

The shift lever 252 with stream receiving aperture 254, is mounted on the upper peripheral edge of the stator housing 194 via shift lever support shaft 256 that is press fit in the housing wall. The shift lever 252 thus rotates with the stator housing 194 but also pivots about shaft 256 (defining a third axis parallel to the center or first axis of the sprinkler head) for movement between notched surfaces 257, 259 on the vertical supports 240, 242, respectively. Shift lever bushings 258, 260 and an associated conventional retaining ring (not shown), adapted to be received in groove 262 may be used to facilitate rotation of the shift lever 252 relative to the shaft 256, but are not required. With reference to FIG. 17, flange 263 engages the upper surface of ring portion 236 and flange 261 engages the lower end of bushing 260 when the shaft 256 is installed.

The stop assembly in this embodiment includes a pair of annular rings 264, 266 that are telescoped over the outer housing 190 below and in proximity to flange 196. The rings are seated one on top of the other and held in place on the housing by conventional retaining rings (not shown) adapted to be seated in grooves 268, 270. The rings 264, 266 are each rotatable relative to the other. The lower ring 266 has a radial projection 272 that supports a first upstanding stop post 274 at its radially outer end. A thumb screw 276 passing through the projection 272 and ring 266 serves to lock the post in the desired position by engaging a groove 278 the wall of the outer housing 190 when tightened.

Similarly, the upper ring 264 has a radial projection 280 that supports a second upstanding stop post 282, also at its radially outer end. Thumb screw 284 is used to lock the post 282 in the desired position by engaging groove 286 in the wall of the outer housing 190. The rotationally adjustable stop posts 274, 282 are thus used to establish any desired arc of rotation of the spray plate 186. Once the arc of rotation is set, the interaction of the stream, spray plate slots, shift lever and stop posts cause the stator sleeve 200 and spray plate 186 to continuously reverse the direction of rotation in substantially the same manner as described above.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A reversible, adjustable arc sprinkler head comprising a sprinkler body incorporating a fixed nozzle; a spray plate mounted on one end of a support cage for rotation with said support cage in one or the other of two opposite directions about a first axis arranged coaxially with a stream emitted from the nozzle, and for back and forth tilting motion about a second axis perpendicular to said first axis, an opposite end of said support cage secured to a sleeve rotatably mounted in said sprinkler body, said spray plate having a pair of substantially parallel grooves for selectively receiving the stream, wherein the direction of rotation of said spray plate about said first axis is determined by the tilting motion of said spray plate about said second axis; and a shift lever formed with an aperture sized to receive said stream, said shift lever mounted at one end on said sleeve for rotation about a third axis parallel to said first axis, said shift lever enabled to shift the stream from one of said pair of grooves to the other of said pair of grooves to thereby reverse the direction of rotation of the spray plate.

2. The sprinkler head of claim 1 wherein said support cage includes a pair of stop surfaces for confining the tilting motion of the spray plate.

3. The sprinkler head of claim 2 wherein said support cage also includes a pair of opposed notches engageable by said shift lever, radially beyond said aperture.

4. The sprinkler head of claim 1 wherein said aperture in said shift lever is shaped to provide a venturi effect which centers the stream within the aperture.

5. The sprinkler head of claim 1 and further comprising a pair of upstanding stop posts arranged for engagement by a remote end of said shift lever, said shift lever normally rotating with said spray plate and said sleeve until said shift lever engages one of said stop posts, causing said shift lever to cease rotating about said first axis and commence rotating about said third axis.

6. The sprinkler head of claim 5 wherein, when said shift lever rotates about said third axis between said stop posts, the shift lever causes the stream to shift to the other of said pair of grooves which, in turn, causes said spray plate to tilt and reverse the direction of rotation thereof.

7. The sprinkler head of claim 1 wherein said pair of substantially parallel grooves are each comprised of a vertical inlet portion and a generally horizontal, radially outward outlet portion.

8. The sprinkler head of claim 1 wherein said aperture in said shift lever is flared at an inlet portion thereof, describing an angle of about 90° between two diametrically opposed surfaces thereof.

9. The sprinkler head of claim 6 wherein said sprinkler body comprises an outer housing, said rotatable sleeve located radially inward of said outer housing, and a fixed, hollow rotor stem that supports said fixed nozzle.

10. The sprinkler head of claim 9 wherein said sleeve comprises a stator housing, with space provided radially between said rotor stem and said stator housing, and further wherein said space is at least partially filled by a viscous fluid.

11. The sprinkler head of claim 10 wherein said space includes enlarged cavities at opposite ends of said rotor stem that also contain viscous fluid.

12. The sprinkler head of claim 9 wherein said stop posts are supported on respective rings rotatably mounted on said outer housing.

13. A reversible, adjustable arc sprinkler head comprising a sprinkler body having an outer housing, a rotatable stator housing supported within said outer housing, and a fixed, hollow rotor stem secured to said outer housing and located radially inward of said stator housing, said rotor stem supporting an axially arranged nozzle; a spray plate mounted in a cage for tilting motion relative to the cage about a horizontal axis; the cage and spray plate mounted at one end on said stator housing for rotation relative to said sprinkler body about one vertical axis, said spray plate having formed therein a pair of substantially parallel grooves adapted to be sequentially aligned with said nozzle for receiving a stream from said nozzle, wherein the direction of rotation of said spray plate about said first axis is determined by the tilting motion of said spray plate about said second axis;

a shift lever extending substantially horizontally and mounted on said stator housing for confined pivotal rotation about another vertical axis, parallel to said one vertical axis, said shift lever having an inner portion with an aperture therein through which a stream emitted from said nozzle may pass; and a stop assembly mounted on said outer housing and including a first rotationally adjustable, annular ring provided with a first stop post, and a second rotationally adjustable, annular ring supported on said first annular ring for rotation relative to said first annular ring, said second annular ring having a second stop post adjustable relative to said first stop post; and wherein said shift lever is arranged to rotate with said stator housing, said cage and said spray plate about said one vertical axis between said first stop post and said second stop post, and to rotate about said another vertical axis after engagement with one of said first stop post and said second stop post.

14. The sprinkler head of claim 13 wherein said first and second stop posts are adjustable relative to each other.

15. The sprinkler head of claim 14 wherein each of said first and second annular rings includes a means for locking the first and second annular rings, respectively, in desired adjusted positions.

16. The sprinkler head of claim 13 including a viscous fluid between said stator housing and said rotor stem for retarding rotational speed of said stator housing and said spray plate.

17. The sprinkler head of claim 16 wherein enlarged cavities are provided at opposite ends of said rotor stem that also contain said viscous fluid.

* * * * *